US006477972B2

(12) United States Patent
Perkins

(10) Patent No.: US 6,477,972 B2
(45) Date of Patent: Nov. 12, 2002

(54) ASSEMBLY OF A SAFETY RAIL FOR AN ACCESS HATCH

(75) Inventor: Simon Perkins, West Falls, NY (US)

(73) Assignee: Kee Kamp Limited, Reading (GB)

( * ) Notice: Subject to any disclaimer, the term of this patent is extended or adjusted under 35 U.S.C. 154(b) by 0 days.

(21) Appl. No.: 09/796,673

(22) Filed: Mar. 2, 2001

(65) Prior Publication Data

US 2002/0124786 A1 Sep. 12, 2002

(51) Int. Cl.[7] ..... B63B 19/12
(52) U.S. Cl. ..... 114/201 R; 182/106
(58) Field of Search ..... 114/201 R; 256/67, 256/59, 24; 182/106, 113; 52/20, 200

(56) References Cited

U.S. PATENT DOCUMENTS 5,145,153 A * 9/1992 Glynn ..... 248/162.1
6,167,659 B1 * 1/2001 Swindell, III ..... 182/106
6,272,800 B1 * 8/2001 Phinney et al. ..... 182/112

* cited by examiner

*Primary Examiner*—Jesus D. Sotelo
(74) *Attorney, Agent, or Firm*—Young & Thompson

(57) ABSTRACT

A safety rail assembly for an access hatch of a kind comprising a hatch frame which defines an opening, said safety rail assembly being adapted to extend around at least a part of a hatch frame thereby to safeguard personnel from inadvertent entry into the hatch opening from at least two mutually perpendicular directions, said safety rail assembly comprising guard members which in use extend at least in part substantially horizontally and support members for supporting the guard members at a position elevated above the hatch frame, said support members each having associated therewith a foot portion for resting in a free-standing manner on a support surface surrounding the hatch frame, and said support members having a resistance to toppling in a direction towards or a direction away from the opening defined by the frame by at least one of a) structural connection to a part of the safety rail assembly at an opposite side of the frame, and b) co-operation of the safety rail assembly with an abutment surface defined by the hatch frame.

13 Claims, 2 Drawing Sheets

ASSEMBLY OF A SAFETY RAIL FOR AN ACCESS HATCH

This invention relates to an assembly of a safety rail for an access hatch and in particular, though not exclusively, for an access hatch for personnel whereby personnel may, for example, gain access to the roof of a building from within the building or vice versa. It relates also to a safety hatch assembly comprising a safety rail assembly and an access hatch.

For an installation comprising a hatch of a size intended for through movement of personnel, or a hatch through which personnel may inadvertently fall, for example a hatch opening in the top of a liquid storage tank, it is known to provide the hatch with a guard rail firmly bolted or otherwise rigidly secured to the roof surface or to the hatch frame.

Whilst it is thereby possible to provide an effective safety rail installation, a need for expenditure and care of installation arises due to the requirement either to bolt to an existing surface surrounding the hatch frame or to secure to the hatch frame. The need for expenditure and care is particularly apparent in the case of a retrofit requirement in which it is necessary to provide an existing access hatch with a surrounding safety rail installation An object of the present invention is to provide a safety rail assembly for an access hatch, and a safety hatch assembly of a safety rail assembly and access hatch in which the safety rail assembly can be provided in a more cost effective and simpler manner than hitherto.

In accordance with one aspect of the present invention there is provided a safety rail assembly for an access hatch of a kind comprising a hatch frame which defines an opening, said safety rail assembly being adapted to extend around at least a part of a hatch frame thereby to safeguard personnel from inadvertent entry into the hatch opening from at least two mutually perpendicular directions, said safety rail assembly comprising guard members which in use extend at least in part substantially horizontally, and support members for supporting the guard members at a position elevated above the hatch frame, said support members each having associated therewith a foot portion for resting in a free-standing manner on a support surface surrounding the hatch frame, and said support members having a resistance to toppling in a direction towards or a direction away from the opening defined by the frame by at least one of:

structural connection to a part of the safety rail assembly at an opposite side of the frame.

co-operation of the safety rail assembly with an abutment surface defined by the hatch frame.

The access hatch may comprise a closure member selectively moveable to open or close an opening defined by said frame The guard members may be of a rigid type and may be rigidly interconnected to one another and to support members whereby the safety rail assembly is a substantially rigid assembly in which the safety rail members at one side of an access hatch frame act as a counter balance or stabiliser to inhibit toppling movement of the safety rail members of an adjacent or opposite side of the safety rail assembly in a direction towards or away from an opening defined by the hatch frame.

Examples of rigid type guard members are metal bars or tubes and also panels of substantially rigid material such as metal plates or grids. A guard member in the form of a panel may be secured to a support member at two or more positions spaced along the length of the support member.

The safety rail members of an adjacent or opposite side may provide said resistance to toppling and said stabilisation either by virtue of their weight and spacing from the stabilised side, or, for example, by engagement with an abutment surface defined by the hatch frame.

It is not, however, essential that the safety rail assembly comprises said rigid assembly of members. A support member may be provided with a foot portion which, relative to the vertical position of an upwardly extending portion of the support member, extends outwards, away from the hatch frame. Thus the foot portion may comprise a flat metal plate which is permanently secured, e.g. welded, to an end of a metal tube or rod that extends vertically upwards to support a guard member, or the foot portion may, for example, be a plate which has secured thereto or formed integrally therewith a stub post or socket to which the lower end of a tube or rod may be secured in a manner known per se. Resistance to toppling in an direction towards the hatch opening is thereby achieved in consequence of the counter-balance might effect of the foot portion.

The support member may comprise a foot portion which is adapted to contact an abutment surface of a hatch access frame in a manner that resists toppling of the support member away from the opening. The access frame may comprise a rim section which outwardly overhangs from a core section of the frame extending upwards from the roof surface there by to define an overhang the underneath surface of which may act as an abutment for engagement by a confronting, e.g. a n upper, surface of an interlock member such as may be comprised by a support member foot portion. The access hatch frame preferably provides said overhangs and abutment surfaces at least at two opposite sides of the frame.

Thus, in accordance with a further aspect of the invention there is provided a safety rail assembly for an access hatch of a kind comprising a hatch frame which defines an opening, said safety rail assembly being adapted to extend around at least a part of a hatch frame thereby to safeguard personnel from inadvertent entry into the hatch opening from at least two mutually perpendicular directions, said safety rail assembly comprising guard members which in use extend at least in part substantially horizontally, and support members for supporting the guard members at a position elevated above the hatch frame, said hatch frame being provided at at least two opposite sides thereof with abutment surfaces which in use face substantially downwards towards but are spaced from a support surface surrounding the hatch frame, and said safety rail assembly having associated therewith interlock members arranged in use to lie between said abutment surfaces and the support surface surrounding the hatch frame whereby said interlock members and abutment surfaces are interengageable to resist upwards movement of the safety rail assembly in a direction away from the support surface.

An interlock member may be comprised by the afore-described foot member(s) provided at the lower end of a support member to rest on the support surfaces surrounding the hatch frame. Alternatively it may be comprised by an auxiliary member secured to or forming part of a lower end region, e.g. foot position, of a support member. The auxiliary member may be a connection member which extends between and which may rigidly interconnect two of the support members.

Particularly, but not necessarily only, if a free-standing support member is provided with stability and resistance to toppling by means of a foot portion thereof, it is not essential that the guard members are rigid. Thus one or more guard members at respective sides of the safety rail assembly may be comprised by a flexible member such as a metal chain or cable.

The guard members may extend between support members at only some of the sides of the frame, e.g. to inhibit inadvertent entry to a hatch opening from two or three directions. Alternatively guard members may be provided to form a safety barrier which inhibits entry from anyone of four mutually perpendicular directions.

For an access hatch which is a personnel access it is envisaged that typically one side of the frame will be devoid of a guard member. The present invention teaches, however, that even if one side of an access hatch frame is devoid of a guard member, that side may be provided with a connection member arranged to extend between and inhibit separation of the respective ends of two sides of the safety rail assembly. Thus if the support members are of a kind having foot portions engageable with an abutment surface of the access hatch framer the connection member may serve to ensure that said foot portions remain in a position in which they are in engagement or engageable with an abutment surface of the frame and cannot readily be displaced outwards, away from the frame to a position at which they cease to be engageable with the frame. Said connection member may serve also to rigidly interconnect two support members such that one support member acts at least in part as a counter balance to assist in resisting toppling movement of the other of the two support members.

Said connection member preferably is provided close to the surface on which the free-standing support members rest. More particularly it is preferred that the connection member does not extend above said surface to a height greater than the height to which the access hatch frame extends above said surface. In the case of an access frame having an overhanging rim portion, said connection member may be positioned to lie in a recess defined by the side of the access frame underneath said overhang. Overhangs may be provided around sides of the frame at different spacings from the support surface whereby one or more overhangs allows a connection member readily to be accommodated in an interlock type position whilst one or more other overhangs closely overlie for example a support member foot plate.

Typically the access hatch frame will be of a rectangular, eg. square or oblong, shape. However it is to be understood that the teaching of the subject invention may be applied also to an access hatch frame of another shape, such as a circular, oval or hexagonal shape, in which case the references herein to sides of the access hatch frame are to be interpreted as sides perpendicular to each of four mutually perpendicular directions from which personnel might inadvertently approach the access hatch.

Preferably the support members are positioned such that even when subjected to forces causing them to tend to slide over the support surface surrounding the access hatch frame, they are at or move to a position in contact with the access hatch frame thereby to inhibit said sliding movement in at least three, and preferably four mutually perpendicular directions. Thus, without the need permanently to secure the support members either to the access hatch frame or the surrounding support surface, it is ensured that the safety rail assembly remains correctly positioned relative to the access hatch frame.

In addition to a safety rail assembly for an access hatch as herein defined the present invention provides also a safety hatch assembly and components therefor comprising a safety rail assembly and an access hatch wherein the safety rail and access hatch assemblies are inter-engageable thereby to enhance the stability of the safety rail.

Embodiments of the present invention will now be described, by way of example only, with reference to the accompanying diagrammatic drawings in which.

Figure 1:
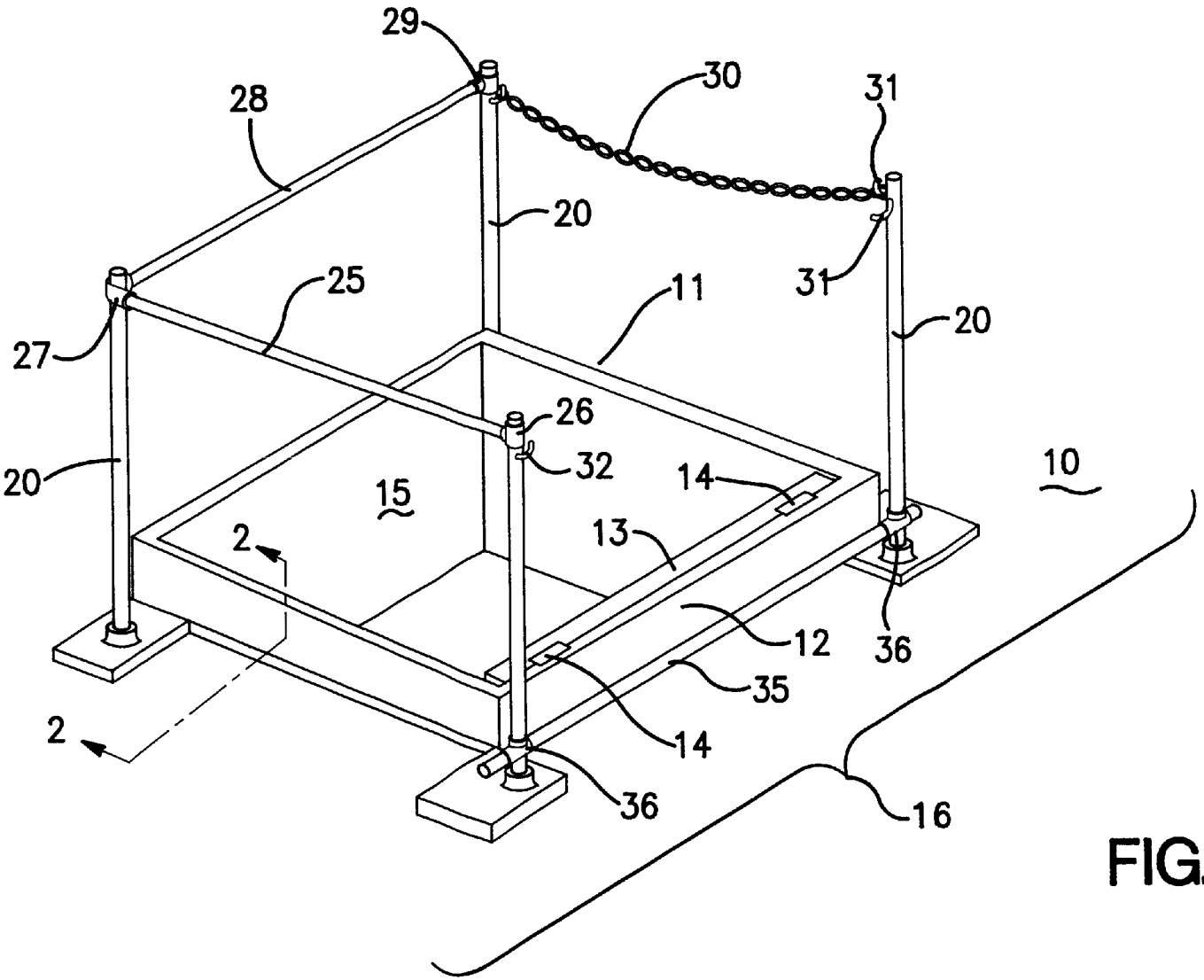
FIG. 1 is a perspective view of a safety rail and roof hatch assembly in accordance with one aspect of the present invention.

With reference to FIG. 1 a roof surface (10) has an opening the boundary of which is lined by a personnel access hatch frame (11) to one side (12) of which a closure panel (13) is hingedly mounted by hinges (14) whereby it may move between an open position, as shown, and a closed position in which it closes and seals the opening defined by the frame (11).

Figure 2:
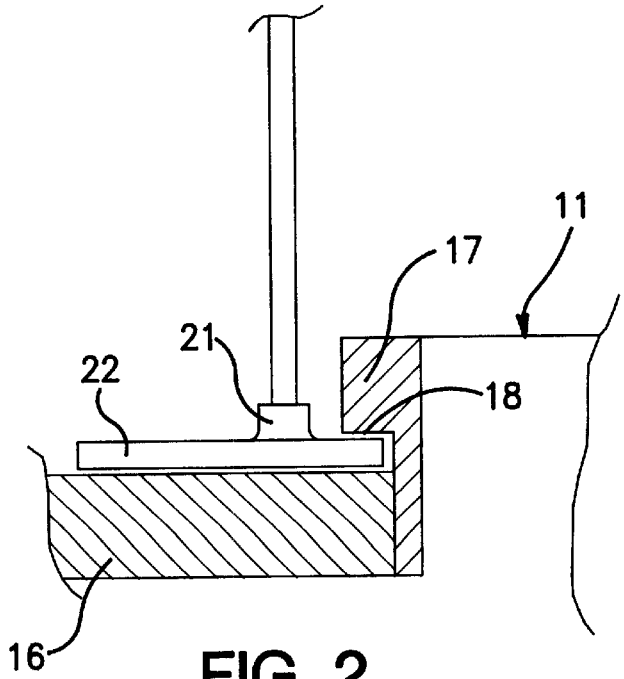
FIG. 2 is a section of part of the assembly of FIG. 1, on the line "XX" of FIG. 1.

The frame (11) is shown part in cross-section in FIG. 2 and comprises a skirt portion (15) which extends downwards as a core through the depth of the roof structure (16). The roof structure (16) is provided in conventional manner with an upper water-tight surface which sealingly contacts the frame (11).

The upper region of the frame (11) is provided with a reinforcing rim (17) which extends outwards from the opening to define an overhang surface (18) which lies spaced slightly above and faces the upper surface of the roof structure (16).

Referring again to FIG. 1, the safety rail installation for the personnel access hatch comprises four vertical posts (20) each having a lower end received in and secured in known manner in a socket (21) formed integrally with and at the upper surface of a rectangular foot plate (22). Each socket (21) is positioned substantially mid way between the longer sides of the rectangular foot plate but closer to one of the shorter sides than the other. Each support post (20) and foot plate (22) lies free-standing on the roof surface (10) and is arranged with the shorter edge of the plate nearest the socket (21) lying tucked under the overhang (18).

In the assembly of this embodiment the foot plates of two posts (20) lie tucked underneath the overhang at one side of the frame, and the other two foot plates lie tucked under the overhang at the opposite side of the frame.

Two of the posts (20) at one side of the frame are interconnected by a rigid guard rail (25) secured to the upper ends of the posts by rigid tube connectors (26, 27,) of a kind known per se. The connector (26) is a two-way connector in which the horizontal rail (25) is connected to an upper end region of a post (20). The connector (27) is a three-way connector in which the associated post is secured by means of the connector to said guard rail (25) and a second horizontally extending rigid guard rail tube (28). The other end of the tube (28) is secured by a two-way connector (29) to another of the vertical posts (20).

At the side of the assembly opposite the guard rail (25) the two posts (20) support a non-rigid guard rail member in the form of a flexible metal chain (30). Chain (30) is secured to the posts by means of hooks (31) and said chain may be moved from the position shown to an alternative position at which it lies between the post having two hooks (31) and the post having the connector (26) and hook (32).

The respective posts with the pair of hooks (31) and the hook (32) are held in a defined spacing by means of a connector tube (35). The connector tube lies substantially wholly beneath the overhang (18) of the side of the frame to which the hinges (14) are fitted, the overhang at this side lying further above the roof support surface (10) than the overhang surfaces (18) of the other three sides of the frame.

Figure 3:
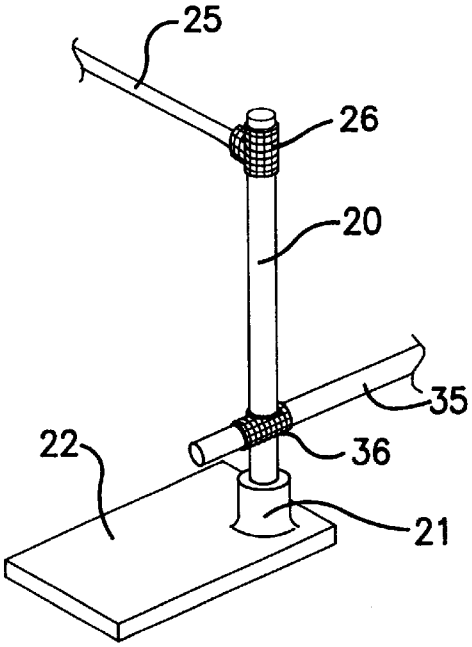
FIG. 3 shows in detail part of the assembly of FIG. 1.

The ends of the connector tube (35) are secured in tube connectors (36) cared by the posts (20) as shown in more detail in FIG. 3, In the aforedescribed embodiment the rigid interconnection of the posts by means of the guard rails (25, 28,) and the connecting rod (35) results in an integral assembly in which the vertical posts inherently tend to resist toppling either towards or away from the opening defined by the hatch frame (11). Additionally, any tendency for sliding movement of the safety rail assembly relative to the hatch frame is resisted in three mutually perpendicular directions by abutment of the foot plates (22) and connection rod (35) with three respective side portions of the frame. Toppling movement is resisted not only by the counter-balance effect achieved in consequence of the rigid structure of the frame, but additionally by the potentially inter-engageable upper surfaces of the foot plates (22) and the over hang abutment surface (18); similarly by potential contact between the connection rod (35) and the abutment overhang (18) at the hinged side of the frame (11).

Figure 4:
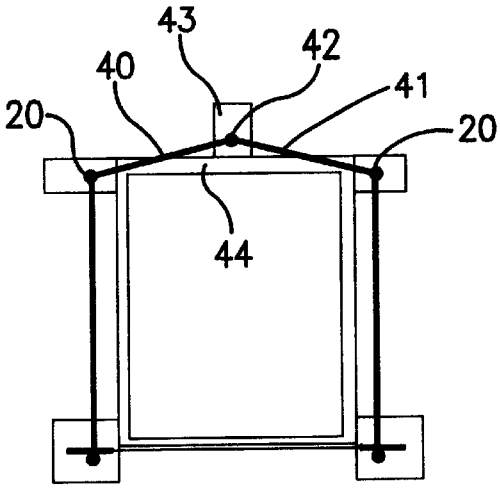
FIG. 4 is a plan view of a safety hatch assembly in accordance with another embodiment of the present invention.

In the configuration shown in FIG. 4 the guard rail (28) of FIG. 1 is replaced by two guard rail sections (40, 41,) which lie inclined relative to one another as viewed in plan. Each of the rigid rails (40, 41,) is secured to a respective comer post (20) and the other ends of the rails (40, 41,) are secured to an additional, intermediate support post (42) supported by a foot plate (43) similar to the aforedescribed foot plates (22). The foot plate (43) serves to engage or potentially engage the side (44) of the frame and in consequence, in combination with the potential inter-engagement of the other foot plates and the connection rod with the other sides of the frame, there is a positive location of the safety rail installation to resist movement in any one of four mutually perpendicular directions relative to the frame.

What is claimed is:

1. A safety rail assembly for an access hatch of a kind comprising a hatch frame which defines an opening, said safety rail assembly being adapted to extend around at least a part of a hatch frame thereby to safeguard personnel from inadvertent entry into the hatch opening from at least two mutually perpendicular directions, said safety rail assembly comprising guard members which in use extend at least in part substantially horizontally, and support members for supporting the guard members at a position elevated above the hatch frame, said support members each having associated therewith a foot portion for resting in a free-standing manner on a support surface surrounding the hatch frame, said support members having a resistance to toppling in a direction towards or a direction away from the opening defined by the frame, wherein said support members have a resistance to toppling in a direction towards or away from the opening defined by the frame by co-operation of the safety rail assembly with an abutment surface defined by the hatch frame, wherein the support member comprises an interlock member for engagement with a confronting surface of the frame, and wherein the access frame comprises a rim section which outwardly overhangs from a core section of the frame to define an overhang the underneath surface of which acts as an abutment for engagement by a confronting surface of an interlock member associated with a support member.

2. A safety rail assembly according to claim 1 wherein the interlock member is comprised by a foot member secured to an end of a support member.

3. A safety rail assembly according to claim 2 wherein said foot member is a substantially rectangular metal plate and the support member is secured to the foot plate at a position which lies closer to one of the two shorter sides than the other.

4. A safety rail assembly according to claim 1 wherein one side of the frame is devoid of a guard member.

5. A safety hatch assembly comprising a safety rail assembly according to claim 1 and an access hatch wherein the safety rail and access hatch assemblies are interengageable thereby to enhance the stability of the safety rail assembly.

6. A safety hatch assembly according to claim 5 wherein the access hatch frame comprises overhang abutment surfaces at at least two opposite sides of the frame.

7. A safety hatch assembly according to claim 6 wherein an overhang abutment surface provided at one side of the frame is at a different spacing from the support surface as compared with the spacing of an abutment surface defined by an overhang of another side of the frame.

8. A safety rail assembly for an hatch of a kind comprising a hatch frame which defines an opening and which is provided at at least two opposite sides thereof with abutment surfaces which in use face substantially downwards towards but are spaced from a support surface surrounding the hatch frame, said safety rail assembly being adapted to extend around at least a part of a hatch frame thereby to safeguard personnel from inadvertent entry into the hatch opening from at least two mutually perpendicular directions, said safety rail assembly comprising guard members which in use extend at least in part substantially horizontally, and support members for supporting the guard members at a position elevated above the hatch frame, and said safety rail assembly having associated therewith interlock members arranged in use to lie between said abutment surfaces and the support surface surrounding the hatch frame whereby said interlock members and abutment surfaces are interengageable to resist upwards movement of the safety rail assembly in a direction away from the support surface.

9. A safety rail assembly according to claim 8 wherein an interlock member is comprised by a foot member provided at the lower end of a support member to rest on the support surface surrounding the hatch frame.

10. A safety rail assembly according to claim 9 wherein an interlock member is comprised by an auxiliary member secured to or forming part of a lower end region of a support member.

11. A safety rail assembly according to claim 10 wherein the auxiliary member is comprised by a connection member which extends between and rigidly interconnects two of the support members.

12. A safety rail assembly according to claim 1 wherein said support members have a resistance to toppling in a direction towards or a direction away from the opening defined by the frame by structural connection to a part of the safety rail assembly at an opposite side of the frame.

13. A safety rail assembly according to claim 12 wherein the guard members are rigid and rigidly interconnect to one another and to support members whereby safety rail members at one side of an access hatch frame inhibit toppling movement of safety rail members of an adjacent or opposite side of the safety rail assembly.

* * * * *